US011231024B2

(12) United States Patent
Cho et al.

(10) Patent No.: US 11,231,024 B2
(45) Date of Patent: Jan. 25, 2022

(54) COMPRESSOR COMPRISING AN UPPER SHELL AND A LOWER SHELL WHEREIN THE UPPER SHELL COMPRISES AN UPPER PROTRUSION COMPRISING A FIRST PROTRUSION AND A SECOND PROTRUSION COMPRISING A TRANSITION AND AN APPROXIMATELY FLAT SHAPE

(71) Applicant: Samsung Electronics Co., Ltd., Suwon-si (KR)

(72) Inventors: Jin Woo Cho, Seongnam-si (KR); Jin Sol Je, Seoul (KR); Ji Hoon Han, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 232 days.

(21) Appl. No.: 15/871,852

(22) Filed: Jan. 15, 2018

(65) Prior Publication Data

US 2018/0230985 A1 Aug. 16, 2018

(30) Foreign Application Priority Data

Feb. 16, 2017 (KR) ..... 10-2017-0021198

(51) Int. Cl.

*F04B 39/12* (2006.01)
*F04B 39/00* (2006.01)
*F04B 39/14* (2006.01)

(52) U.S. Cl.

CPC ..... *F04B 39/121* (2013.01); *F04B 39/0027* (2013.01); *F04B 39/0044* (2013.01);
(Continued)

(58) Field of Classification Search

CPC .... F04B 39/0027; F04B 39/121; F04B 39/14; F04B 2201/0804; F04B 39/0044;
(Continued)

(56) References Cited

U.S. PATENT DOCUMENTS 4,347,043 A * 8/1982 Morris ..... F04B 39/0033 181/202
5,435,702 A * 7/1995 Koyama ..... F04B 35/04 310/51

(Continued)

FOREIGN PATENT DOCUMENTS

AT 10950 U1 1/2010
CN 102108960 A 6/2011

(Continued)

OTHER PUBLICATIONS

European Search Report dated Jun. 15, 2018 in connection with European Patent Application No. 18 15 2703.

(Continued)

*Primary Examiner* — Patrick Hamo
*Assistant Examiner* — Benjamin Doyle

(57) ABSTRACT

A compressor is disclosed. The compressor includes an upper shell and a lower shell forming an appearance of the compressor. The compressor also includes a coupling portion provided between the upper shell and the lower shell and configured to protrude from a side surface of the upper shell or the lower shell to outside the upper shell or the lower shell. The coupling portion includes at least one coupling protrusion configured to protrude from a side surface of a flange portion to the outside, to increase a rigidity of the flange portion and the coupling portion.

18 Claims, 9 Drawing Sheets

(52) U.S. Cl.
CPC ..... *F04B 39/127* (2013.01); *F04B 39/14* (2013.01); *F04B 2201/0804* (2013.01)

(58) Field of Classification Search
CPC .... F04B 39/127; F04B 35/04; F04B 39/0033; F04B 39/003; F04B 39/023; F01C 21/10; F04C 2240/30; F04C 23/008; F04C 29/066
USPC ..... 417/313, 902
See application file for complete search history.

(56) References Cited

U.S. PATENT DOCUMENTS 5,443,371 A * 8/1995 Calciolari ..... F04B 39/0027 181/280
5,487,648 A * 1/1996 Alfano ..... F04B 39/0033 417/312
5,538,404 A * 7/1996 DiFlora ..... F04B 39/0033 181/200
5,577,898 A * 11/1996 Lee ..... F04B 39/0072 417/312
5,588,810 A * 12/1996 DiFlora ..... F04B 39/0033 181/202
D384,678 S * 10/1997 Kotlarek ..... D15/9
5,997,258 A * 12/1999 Sawyer, III ..... F04B 39/0033 181/202
6,000,500 A * 12/1999 Oh ..... F04B 39/0027 184/6.16
6,435,841 B1 * 8/2002 Kim ..... F04B 39/0033 417/312
6,872,057 B2 3/2005 Kim
8,616,860 B2 * 12/2013 Wollitz ..... F04B 53/00 181/198
9,051,835 B2 * 6/2015 Rogalski ..... F01C 21/10
9,153,225 B2 * 10/2015 Bonitas ..... G10K 11/16
9,397,529 B2 * 7/2016 Watanabe ..... F04B 35/04
9,447,924 B2 * 9/2016 Fukasaku ..... F04C 23/008
9,759,209 B2 * 9/2017 Fang ..... F04B 39/0061
2001/0021350 A1 * 9/2001 Kim ..... F04B 39/0027 417/363
2002/0051716 A1 * 5/2002 Seo ..... F04B 39/0033 417/415
2003/0124004 A1 * 7/2003 Dreiman ..... F04B 35/04 417/366
2004/0052659 A1 * 3/2004 Kim ..... F04B 39/0027 417/363
2004/0219033 A1 * 11/2004 Narney, II ..... F04B 39/0027 417/313
2005/0226749 A1 * 10/2005 Nakamura ..... F04B 27/1036 417/441
2005/0274569 A1 * 12/2005 Seel, V ..... F01C 21/10 181/202
2008/0136280 A1 * 6/2008 Hsiao ..... F04B 35/04 310/114
2010/0172770 A1 * 7/2010 Ichise ..... F04B 35/04 417/366
2010/0209266 A1 * 8/2010 Ikeda ..... F04B 35/04 417/410.1
2012/0045353 A1 * 2/2012 Watanabe ..... F04B 35/04 417/410.1
2012/0076679 A1 * 3/2012 Saito ..... F04B 39/00 417/410.1
2012/0177513 A1 * 7/2012 Lilie ..... F04B 39/0044 417/417
2013/0251551 A1 * 9/2013 Bessel ..... F04B 35/04 417/321
2014/0053720 A1 * 2/2014 Ahn ..... F04B 39/0005 91/418
2014/0322040 A1 * 10/2014 Cho ..... F04B 39/0072 417/312
2015/0061421 A1 * 3/2015 Yano ..... H02K 9/00 310/52
2015/0354552 A1 * 12/2015 Inagaki ..... F04B 39/0005 417/415
2016/0003253 A1 * 1/2016 Lee ..... F04C 29/068 417/420
2016/0056699 A1 * 2/2016 Jeong ..... F04B 39/122 417/416
2016/0131123 A1 * 5/2016 Kim ..... F04B 39/123 417/312
2018/0087494 A1 * 3/2018 Brune ..... B32B 27/32

FOREIGN PATENT DOCUMENTS

CN 202338461 U 7/2012
CN 204312293 U 5/2015
CN 205744368 U 11/2016
GN 205260268 U 5/2016
JP 2000297756 A 10/2000
JP 2009275566 A 11/2009
KR 2001-0054819 A 7/2001
WO 2009/132934 A1 11/2009

OTHER PUBLICATIONS

Office Action dated Jan. 18, 2019 in connection with Chinese Patent Application No. 201810149230.2, 16 pages.
Office Action dated Oct. 9, 2019 in connection with Chinese Patent Application No. 201810149230.2, 18 pages.

* cited by examiner

COMPRESSOR COMPRISING AN UPPER SHELL AND A LOWER SHELL WHEREIN THE UPPER SHELL COMPRISES AN UPPER PROTRUSION COMPRISING A FIRST PROTRUSION AND A SECOND PROTRUSION COMPRISING A TRANSITION AND AN APPROXIMATELY FLAT SHAPE

CROSS-REFERENCE TO RELATED APPLICATION AND CLAIM OF PRIORITY

This application is related to and claims priority to Korean Patent Application No. 10-2017-0021198, filed on Feb. 16, 2017, the contents of which are incorporated herein by reference.

TECHNICAL FIELD

Embodiments of the present disclosure relate to a compressor, more particularly to a compressor provided with a housing having an improved shape.

BACKGROUND

Generally, a compressor is a mechanical apparatus that receives power from a power generator such as a motor or a turbine, and compresses air, refrigerant or various working gases to increase the pressure. It is widely used in home appliances such as refrigerators and air conditioners or throughout the industry.

According to a compression method and a closed structure, the compressor may be classified into a reciprocating compressor, a rotary compressor and a scroll compressor.

Particularly, the reciprocating compressor is configured to form a compression space in which a working gas is suctioned and discharged between a piston and a cylinder, so as to allow the piston to linearly reciprocate inside the cylinder, thereby compressing the refrigerant.

Generally, a noise generated from the compressor may be present in the low-frequency noise of less than 1 kHz and high frequency noise of more than 1 kHz. The low-frequency noise is mostly caused by the flow in the compressor, and the high-frequency noise may correspond to a radiated noise due to the vibration of the housing of the compressor.

In order to reduce the high-frequency noise of the compressor, it is desirable to minimize the vibration of the motor and the pump which are the cause of the vibration. However, it may be difficult to completely eliminate the vibration due to the driving principle of the compressor.

The vibration inside the compressor can be transmitted to the housing surrounding the outer circumference of the compressor, thereby vibrating the housing. When the housing vibrates, the noise can be radiated to the outside of the housing.

If the rigidity of the housing is increased to reduce the vibration transmitted to the housing, the high frequency noise radiated from the housing can be reduced.

Generally, the housing of the compressor may be manufactured such that two steel plate structures having a hemispheric shape are welded and a steel sheet in a certain thickness may have the hemispheric shape by a press method.

The housing may be manufactured to have a constant distance so that a contact with structures placed in the compressor is prevented. A shape of welding portion in which two steel plate structures, i.e., an upper portion and a lower portion, are welded, may have an oval shape, and there may be little local curvature change.

A lower central portion of the housing may be formed in a flat shape. When the shape of the wielding portion has an oval shape in which a curvature is gentle, or when the lower central portion of the housing has a flat shape, it may be vulnerable to vibration transmitted from the inside of the housing.

SUMMARY

To address the above-discussed deficiencies, it is a primary object to provide a compressor having an improved structure to increase the rigidity of a housing of the compressor by changing the shape of the housing.

It is another aspect of the present disclosure to provide a compressor having an improved structure to reduce a noise transmitted to a housing, particularly a high frequency noise radiated to the outside of the housing, by increasing the rigidity of the housing by forming a protrusion portion having a certain curvature in a side portion and a bottom portion of the housing, which are relatively greatly vibrated.

Additional aspects of the present disclosure will be set forth in part in the description which follows and, in part, will be evident from the description, or may be learned by practice of the present disclosure.

In accordance with one aspect of the present disclosure, a compressor may include an upper shell and a lower shell forming an appearance of the compressor, and a coupling portion provided between the upper shell and the lower shell and configured to protrude from a side surface of the upper shell or the lower shell to the outside, wherein the coupling portion may include at least one coupling protrusion configured to protrude from a side surface of a flange portion to the outside, so as to increase a rigidity of the flange portion and the coupling portion.

The coupling protrusion may include a first coupling protrusion bent and extended from the flange portion, and a second coupling protrusion bent and extended from the first coupling protrusion.

The upper shell may include an upper protrusion extended from the coupling protrusion to the upper shell.

The lower shell may include a lower protrusion extended from the coupling protrusion to the lower shell.

The upper shell may include a ceiling protrusion configured to protrude from an upper main portion forming an appearance of the upper shell, to an upper side, so as to increase a rigidity of the upper shell.

The coupling protrusion may protrude by a height corresponding to from one tenth (1/10) to five times of a thickness of the lower shell.

The lower shell may include a bottom protrusion configured to protrude from a lower main portion forming an appearance of the lower shell, to the outside, so as to increase a rigidity of the lower shell.

The bottom protrusion may protrude by a height corresponding to from one tenth (1/10) to five times of a thickness of the lower shell.

The coupling portion may include a plurality of first coupling portions disposed to face to each other, wherein the coupling protrusion may be provided in plural to correspond to the plurality of first coupling portions.

The coupling protrusion may be provided in plural in at least one first coupling portion among the plurality of first coupling portions.

The coupling protrusion may be integrally coupled to the upper protrusion to form a protrusion so as to form a bead configured to increase the rigidity.

The coupling protrusion may be arranged to be inclined.

The coupling protrusion may be arranged to be stepped.

The coupling portion may include a first coupling portion, a second coupling portion having a length less than a length of the first coupling portion, and a third coupling portion having a curvature and connecting the first coupling portion to the second coupling portion, wherein the coupling protrusion may be provided in the first coupling portion.

An outer surface of the upper protrusion may be in contact with an inner surface of the coupling protrusion.

In accordance with another aspect of the present disclosure, a compressor may include a housing provided with an accommodating portion configured to accommodate a drive device and a compression device, wherein the housing may include a main portion configured to form an appearance of the housing, and a protrusion configured to protrude from the main portion to the outside, wherein the protrusion may include a first protrusion provided in an edge portion of the protrusion and configured to be bent and extended from an outer surface of the main portion, and a second protrusion configured to be bent and extended from the first protrusion.

The housing may include an upper shell and a lower shell configured to form the accommodating portion, and a coupling portion provided between the upper shell and the lower shell to allow the upper shell to be coupled to the lower shell, wherein a part of the protrusion may be provided in the coupling portion.

The protrusion may be provided in an upper portion of the housing.

The protrusion may be provided in a bottom portion of the housing.

In accordance with still another aspect of the present disclosure, a compressor may include an upper shell configured to form an appearance of the compressor, a lower shell coupled to the upper shell, a first coupling portion configured to include a part of a flange portion provided between the upper shell and the lower shell, a second coupling portion bent and extended from the first coupling portion, a coupling protrusion provided in the first coupling and configured to be extended to be stepped from a side surface of the flange portion to the outside, an upper protrusion configured to be extended to be stepped from the coupling protrusion to the upper shell, and a lower protrusion configured to be extended to be stepped from the coupling protrusion to the lower shell.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
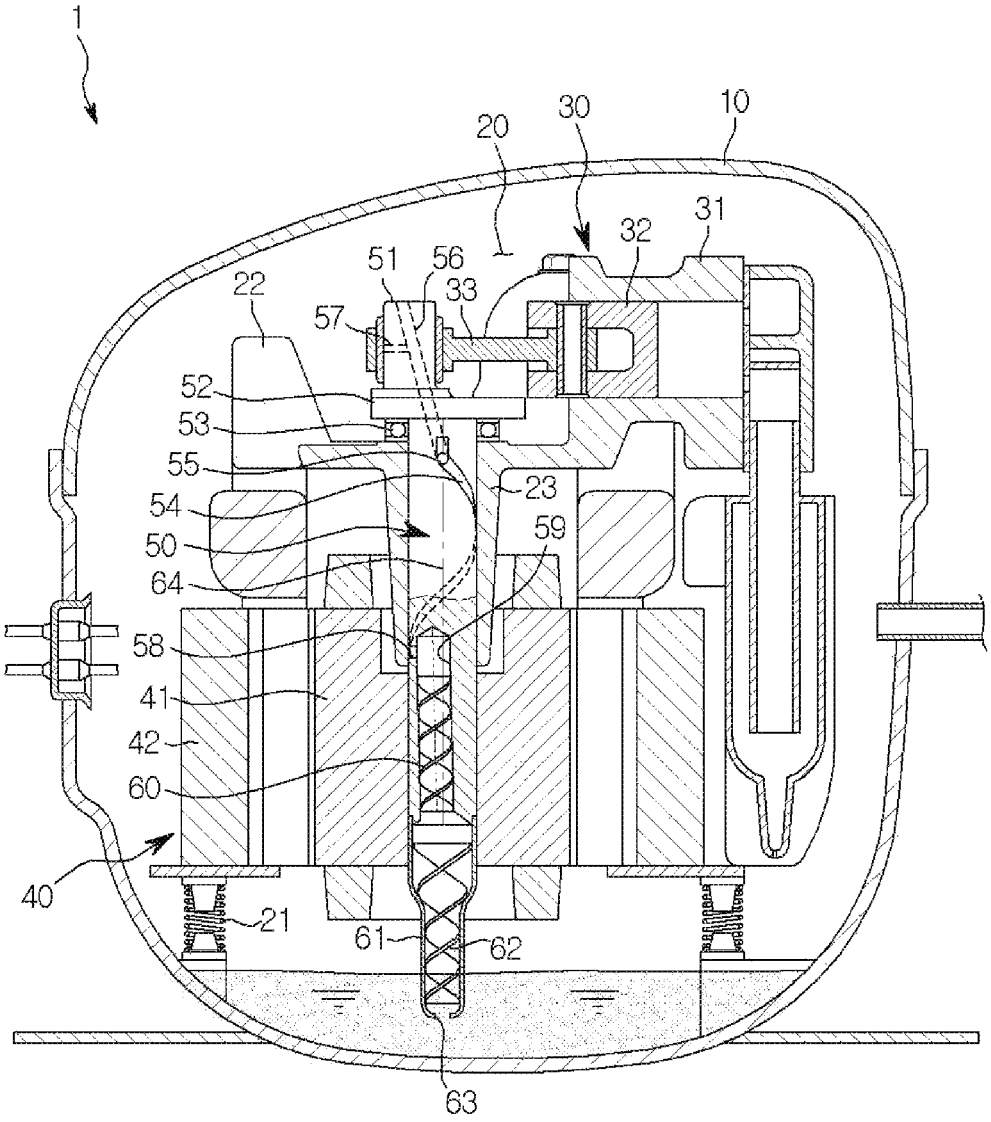
FIG. 1 illustrates a schematic cross-sectional view illustrating a compressor in accordance with an embodiment of the present disclosure.

FIGS. 1 through 9, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Embodiments described in the present disclosure and configurations shown in the drawings are merely examples of the embodiments of the present disclosure, and may be modified in various different ways at the time of filing of the present application to replace the embodiments and drawings of the present disclosure.

In addition, the same reference numerals or signs shown in the drawings of the present disclosure indicate elements or components performing substantially the same function. Also, the terms used herein are used to describe the embodiments and are not intended to limit and/or restrict the present disclosure.

The singular forms "a," "an" and "the" are intended to include the plural forms as well, unless the context clearly indicates otherwise. In this present disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element.

For example, without departing from the scope of the present disclosure, a first element may be termed as a second element, and a second element may be termed as a first element.

The term of "and/or" includes a plurality of combinations of relevant items or any one item among a plurality of relevant items.

In the following detailed description, the terms of "front side, "rear side", "upper portion", "lower portion" and the like may be defined by the drawings, but the shape and the location of the component is not limited by the term.

The present disclosure will be described more fully hereinafter with reference to the accompanying drawings FIG. 1 illustrates a schematic cross-sectional view illustrating a compressor in accordance with an embodiment of the present disclosure. Generally, according to a compression method and a closed structure, the compressor may be classified into a reciprocating compressor, a rotary compressor and a scroll compressor.

The reciprocating compressor is operated such that a compression space in which a working gas is sucked and discharged is formed between a piston and a cylinder, and the piston reciprocates linearly in the cylinder to compress the refrigerant.

The rotary compressor is operated such that a compression space in which a working gas is sucked and discharged is formed between a rolling piston that rotates eccentrically and a cylinder, and the rolling piston eccentrically rotates along the inner wall of the cylinder to compress the refrigerant.

The scroll compressor is operated such that a compression space in which a working gas is sucked and discharged is formed between an orbiting scroll and a fixed scroll, and the orbiting scroll rotates along the fixed scroll to compress the refrigerant.

The embodiment of the compressor 1 will be described as an example of the reciprocating compressor, but is not limited thereto. That is, the present embodiment may be applied to the rotary compressor and the scroll compressor other than the reciprocating compressor.

As illustrated in FIG. 1, the compressor 1 may include a housing 10 forming an appearance thereof. The housing 10 may include an accommodating portion 20 therein. Generally, the housing 10 may be manufactured by performing a plastic working on a steel plate by using a deep drawing method.

The housing 10 may form the accommodating portion 20 that is a closed space, therein, and may accommodate a variety of components forming the compressor 1 in the accommodating portion 20. The housing 10 may be formed of a metal material.

The compressor 1 may include a frame 22 supported by a shock absorber 21 to fix a variety of components in the housing 10, and a compression device 30 installed in the upper side of the frame 22.

The compressor 1 may include a drive device 40 installed in a lower side of the frame 22 to drive the compression device 30, and a rotary shaft 50 vertically disposed to transmit a driving force of the drive device 40 to the compression device 30 and rotatably supported by a shaft supporter 23 of the frame 22.

The compression device 30 may include a cylinder 31 configured form a compression space of the refrigerant and fixed to the frame 22, and a piston 32 configured to compress the refrigerant by moving back and forth in the cylinder 31.

The drive device 40 may include a stator 42 fixed to the frame 22 and a rotor 41 rotated in the stator 42.

The rotor 41 may include a hollow in which the rotary shaft 50 is placed, and the rotary shaft 50 may be fitted and inserted into the hollow of the rotor 41 and then coupled to the rotor 41 to be rotated together with the rotor 41.

The stator 42 may include a stator core (not shown) corresponding to a portion, which is fixed during the drive device 40 is rotated, and a stator coil (not shown) mounted to the inner side of the stator core (not shown).

The stator core (not shown) may be formed of a metal material and formed in an approximately cylindrical shape. When the voltage is applied from a power supplier (not shown), the stator coil (not shown) may generate an electromagnetic force to perform an electromagnetic interaction with the stator core (not shown) and the rotor 41.

The drive device 40 may include an insulator (not shown) disposed between the stator core (not shown) and the stator coil (not shown). The insulator (not shown) may prevent a direct contact between the stator core (not shown) and the stator coil (not shown).

When the stator coil (not shown) is in a direct contact with the stator core (not shown), it may be prevented that the stator coil (not shown) generates the electromagnetic force. The insulator (not shown) may allow the stator core (not shown) and the stator coil (not shown) to be apart from each other by a certain distance.

The rotor 41 may be rotatably mounted to the inside of the stator coil (not shown). A magnet may be provided in the rotor 41. When the voltage is applied, the rotor 41 may be rotated by the electromagnetic interaction with the stator core (not shown) and the stator coil (not shown).

In the upper portion of the rotary shaft 50, an eccentric portion 51 eccentric from a rotational center shaft may be provided, and the eccentric portion 51 may be connected to the piston 32 by a connecting rod 33. The rotational motion of the rotary shaft 50 may be converted into the linear motion of the piston 32 by the eccentric portion 51 and the connecting rod 33.

The connecting rod 33 may be formed of sintered alloy material.

The cylinder 31 may be formed of aluminum material. The aluminum material may be aluminum or an aluminum alloy. Since the aluminum material is non-magnetic, magnetic flux generated in the rotor 41 may be not transmitted to the cylinder 31.

Therefore, it may be prevented that the magnetic flux generated in the rotor 41 is transmitted to the cylinder 31 and then leaked to the outside of the cylinder 31.

The piston 32 may be formed of aluminum material in the same as the cylinder 31. Therefore, in the same manner as the cylinder 31, it may be prevented that the magnetic flux generated in the rotor 41 is transmitted to the piston 32 and then leaked to the outside of the piston 32.

Since the piston 32 is formed of the same material as the cylinder 31, a thermal expansion coefficient of the piston 32 and the cylinder 31 may be similar with each other.

Since the piston 32 has a thermal expansion coefficient similar with the cylinder 31, the piston 32 and the cylinder 31 may be thermally deformed almost the same amount in a high temperature environment of the housing 10 (e.g., approximately 100° C.) when the compressor 1 is driven.

Therefore, it may be possible to prevent the interruption between the piston 32 and the cylinder 31 when the reciprocating motion of the piston 32 is performed in the cylinder 31, but is not limited thereto.

In a lower side of the eccentric portion 51, a disk portion 52 extending in a radial direction may be formed. A thrust bearing 53 may be provided between the disk portion 52 and the shaft supporter 23 to support an axial load of the rotary shaft 50 to allow the rotary shaft 50 to be smoothly rotated.

In the lower portion of the housing 10, oil may be stored for lubrication and cooling between various components of the compressor 1, and the oil may be raised through the rotary shaft 50 and supplied to the respective components.

In the lower side of the rotary shaft 50, a guide cap 61 submerged in the oil to pull up the oil stored in the housing 10, and a second spiral blade 62 formed in the guide cap 61 may be provided.

An opening 63 may be formed in the lower portion of the guide cap 61 to allow the oil to flow into the inside of the guide cap 61. As the guide cap 61 and the second spiral blade 62 are rotated together with the rotary shaft 50, the guide cap 61 and the second spiral blade 62 may guide the oil stored in the housing 10 to an inner flow path 59.

The inner flow path 59 may be formed slightly eccentric from a central shaft 64 of the rotary shaft 50, and oil guided to the inner flow path 59 may be raised by the centrifugal force upon the rotation of the rotary shaft 50. In the inner flow path 59, a first spiral blade 60 may be provided to improve the lifting force of the oil.

A helical groove 54 communicated with the inner flow path 59 via a second communication hole 58 may be formed on an upper outer circumferential surface of the rotary shaft 50.

Oil lifted by the inner flow path 59 may be guided to the helical groove 54 of the outer circumferential surface of the rotary shaft 50 via the second communication hole 58 and the oil guided to the helical groove 54 may be lifted by the centrifugal force while lubricating between the rotary shaft 50 and the shaft supporter 23 of the frame 22.

In the inside of the upper portion of the rotary shaft 50, a first supply flow path 56 and a second supply flow path 57 communicated with the helical groove 54 via the first communication hole 55 may be formed and the oil may be supplied to the upper side of the eccentric portion 51 and the side of the piston 32 via the first supply flow path 56 and the second supply flow path 57.

Figure 2:
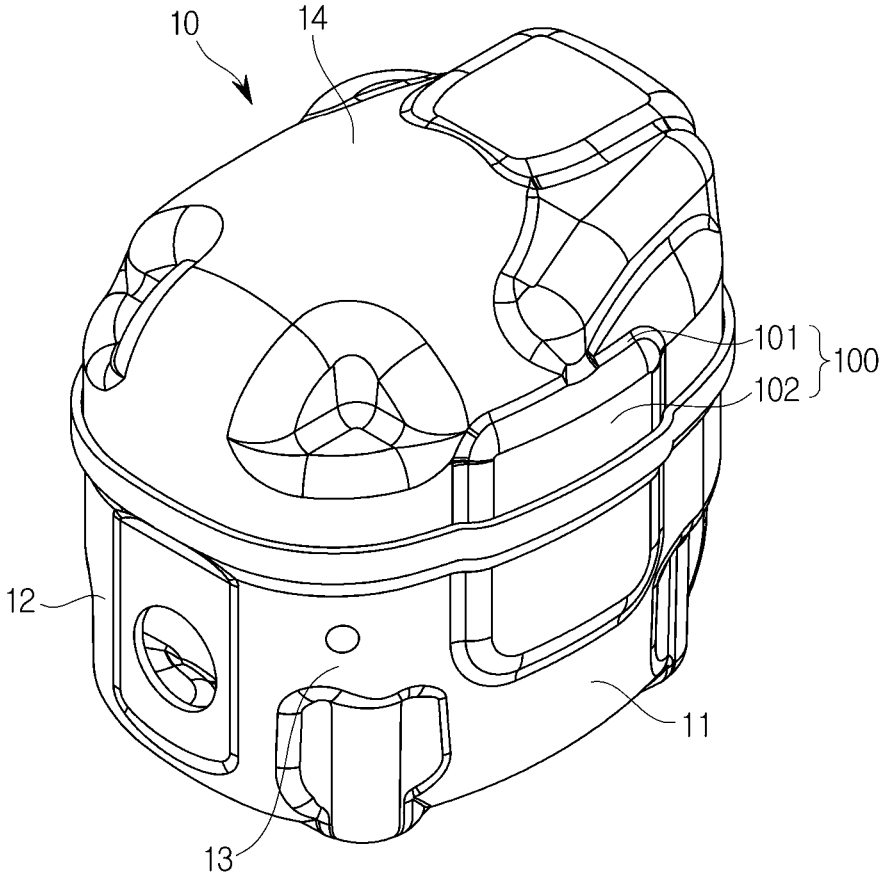
FIG. 2 illustrates a perspective view of the compressor in accordance with an embodiment of the present disclosure.

FIG. 2 illustrates a perspective view of the compressor in accordance with an embodiment of the present disclosure. As illustrated in FIG. 2, the compressor 1 may include the housing 10 having the accommodating portion 20 in which the drive device 40 and the compression device 30 are placed.

The compressor 1 according to an embodiment may be used in various home appliances such as a water purifier and a refrigerator. The compressor 1 as illustrated in FIG. 2 is mainly used for the water purifier, but is not limited thereto.

Generally, as for the housing 10 of the compressor 1, although the vibration isolation is performed by the shock absorber 21 fixed to the inside of the accommodating portion 20, the large amount of the vibration may be transmitted to the housing 10 without the change and thus the vibration generated in the inside of the housing 10 may be largely transmitted.

The compressor 1 may generate the noise caused by a pressure pulsation or opening and closing of a valve in the housing 10 during the compressor 1 suctions, compresses and discharges the gas.

When the noise generated in the housing 10 is radiated to the outside via the housing 10 and when the radiated noise is large, it may be possible to reduce the reliability of the compressor 1 from a user.

Particularly, when the compressor 1 makes the noise after being mounted to a home appliance such a refrigerator and an air conditioning apparatus, it may lead to the fatal defect on the reliability of the product.

The compressor 1 may have a natural frequency on a variety of components forming the compressor 1.

For example, the compressor 1 may have a natural frequency about the volume of the housing 10, and a natural frequency about internal components including the compression device 30 and the drive device 40.

Meanwhile, when the drive of the compressor 1 is started, a drive frequency may occur by the vibration generated inside of the compressor 1.

Each frequency may be closely related to the noise generated in the compressor 1. Particularly, when the natural frequency is synchronized with the drive frequency, the resonance phenomenon may occur.

When the resonance phenomenon occurs, a noise generated in the accommodating portion 20 may be sufficiently increased. Therefore, it may be required that the resonance phenomenon corresponding to the synchronization of the frequency is prevented regardless of the period.

However, since the natural frequency generated in the housing 10 varies, it may be difficult to avoid the resonance phenomenon with the drive frequency and thus it may be needed to have a structure of the housing 10 to relatively reduce the noise although the resonance phenomenon occurs.

The housing 10 may include a main portion forming an appearance of the housing 10, and a protrusion 100 protruding outward from the main portion.

The protrusion 100 may include a first protrusion 101 provided in the edge portion of the protrusion 100 to be bent and extended from the outer surface of the main portion and a second protrusion 102 bent and extended from the first protrusion 101.

The second protrusion 102 may be surrounded by the first protrusion 101. The second protrusion 102 may have an approximately flat shape in which the change in a local curvature is little which is similar with the main portion.

The first protrusion 101 may have a curvature greater than a curvature of the second protrusion 102 and the main portion.

Since the protrusion 100 is provided in the housing 10, the rigidity of the housing 10 may be relatively increased in comparison with the housing 10 having the approximately flat shape in which the change in the local curvature is little.

Since the rigidity of the housing 10 is increased, the housing 10 may be more resistant to the vibration generated in the compression device 30 and the drive device 40 in the housing 10.

Since the housing 10 is more resistant to the vibration, it may be possible to reduce the noise that is radiated from the inside to the outside of the housing 10 although the housing 10 is formed by a steel plate in the same thickness.

Since the housing 10 is more resistant to the vibration, it may be possible to allow the noise to have the same level as a case of using a steel plate in a relatively thickness, despite of using the housing 10 formed by a steel plate in a thinner thickness Therefore, it may be possible to manufacture the housing 10 by using a relatively thin steel plate, and thus the manufacturing cost of the housing 10 may be reduced.

The housing 10 may include a first side portion 11, a second side portion 12 and a third side portion 13 having a certain curvature to connect the first side portion 11 to the second side portion 12.

The first side portion 11, the second side portion 12 and the third side portion 13 may be provided in plural.

The housing 10 may have a substantially hexahedral shape, and may include two first side portions 11, two second side portions 12, and four third side portions 13 connecting the two first side portions 11 to the two second side portions 12, but is not limited thereto.

Alternatively, the number of the first side portion 11, the second side portion 12 and the third side portion 13 may vary according to the shape of the housing 10 as long as capable of forming the side portion of the housing 10.

The first side portion 11 is longer than the second side portion 12 to allow the compression action of the cylinder 31 and the piston 32 of the compression device 30 accommodated in the housing 10, but is not limited thereto. Alternatively, the length of the first side portion 11 may be the same as or less than the length of the second side portion 12.

Since the curvature of the first side portion 11 and the curvature of the second side portion 12 are similar with each other, the second side portion 12 having a relatively short length may be stronger than the first side portion 11 having a relative long length.

The protrusion 100 may be provided in the first side portion 11. Since the protrusion 100 configured to increase the rigidity of the housing 10 has a relatively long length, it may be appropriate that the protrusion 100 is provided in the first side portion 11 having a relatively less rigidity.

It may be possible to reduce the displacement in which the housing 10 is vibrated, by reinforcing the rigidity of the housing 10. The protrusion 100 may be provided in any one of the first side portion 11, the second side portion 12, the third side portion 13, an upper portion 14, and a bottom portion 15.

Since the protrusion 100 is provided not in the second side portion 12 or the third side portion 13, but in the first side portion 11 having a relatively long length, it may be possible to reinforce the first side portion 11 having a relatively less rigidity and thus it may be possible to maximize the reduction of the vibration.

That is, it may be appropriate that the protrusion 100 is provided in the first side portion 11, which is relatively vulnerable to the vibration since the first side portion 11 has a relatively wide area with no curvature. Since the protrusion 100 is provided in the housing 10, the rigidity of the housing 10 may be increased and thus although the resonance phenomenon occurs, it may be possible to relatively minimize a case in which the noise generated in the housing 10 is radiated to the outside.

The protrusion 100 may have a rectangular shape having a rounded corner, but is not limited thereto. The protrusion 100 may have a variety of shapes as long as extending outward from the main portion with a certain curvature.

In comparison with a case in which the protrusion 100 has a plurality of small embossing, the protrusion 100 may be more resistant to the vibration, which is generated in not the local, but the entire of the housing 10, since the protrusion 100 is formed in a rectangular shape having a certain area.

A user using a home appliance to which the compressor 1 is applied, may be sensitive to the noise and the user may be less sensitive to the noise as the noise has a higher frequency.

That is, when the noise generated in the compressor 1 is analyzed, the noise generated in the compressor 1 may be classified into a noise source caused by the compression of the refrigerant gas in the housing 10, and a noise generated a case in which the housing 10 is vibrated by the noise source.

The noise transmitted to the outside of the housing 10 may be relatively more affected by the noise generated the case in which the housing 10 is vibrated by the noise source, than the noise source caused by the compression of the refrigerant gas in the housing 10.

In order to reduce the noise radiated to the outside of the housing 10, it may be beneficial to reduce a noise, which is practically felt by a user, and since the user is relatively less sensitive to a noise in the high frequency region than the low frequency region, and thus it may be beneficial to increase the natural frequency of the housing 10.

A natural frequency (W) of the housing 10 may be proportional to a thickness (t) of the housing 10 and inversely proportional to the square of a radius (r) of the housing 10. Therefore, in order to increase the natural frequency of the housing 10, it may be beneficial to reduce the radius (r) of the housing 10 or to increase the thickness (t) of the housing 10.

When the thickness (t) of the housing 10 is thick, the weight of the entire housing 10 may be increased and thus the material cost for manufacturing the housing 10 may be increased.

In addition, the change in the radius (r) of the housing 10 may be limited since a minimal space, to which the compression device 30 and the compression device 30 accommodated in the accommodating portion 20 of the housing 10 are mounted, is needed to be secured in the accommodating portion 20.

Meanwhile, since a reinforcing band is formed in the structure of the housing 10, it may be possible to increase the natural frequency by reinforcing the rigidity of the housing 10. However, when a plurality of reinforcing bands is welded or fitted-coupled to the housing 10, an additional assembly man hour and a large amount of time may be needed and thus the productivity may be reduced.

When the noise generated inside the housing 10 is radiated to the outside of the housing 10, the transmission of the noise may be easily performed in a state in which the surface of the housing 10 has a flat shape.

That is, when the surface of the housing 10 is flat, the level of the transmission of the noise, which is radiated to the outside, may be relatively high. However, when the protrusion 100 is formed in the surface of the housing 10, the rigidity of the housing 10 may be improved and the vibration transmitted to the housing 10 may be reduced so that the transmission of the noise to the outside may be reduced.

According to an embodiment, as for the compressor 1, by using the protrusion 100, the natural frequency, which vibrates the first side portion 11, may be changed from a range of from about 2.5 kHz to 2.7 kHz, which is relatively sensitive for a user, to a range of from about 2.8 kHz to 3.1 kHz.

Therefore, as a result, an amount of vibration of the first side portion 11 may be reduced and the noise felt by the user via the vibration may be reduced.

That is, according to an embodiment, the compressor 1 may improve the noise generated in the range of about 2.5 kHz, from about 34 dB to 45 dB to about 28 dB to 38 dB, thereby reducing the noise by about 5 dB.

In addition, when a home appliance such as an air purifier to which the compressor 1 according to an embodiment is mounted, is operated, the noise felt by a user in the range of about 2-3 kHz may be improved from about 21 dB to about 16 dB at least, and thus the noise of about 5 dB may be reduced. The noise may be maximally improved from about 23 dB to the about 16 dB, and thus the noise of about 7 dB may be reduced.

The housing 10 may include the upper portion 14. The upper portion 14 may be connected to the first side portion 11, the second side portion 12, and the third side portion 13.

Figure 3:
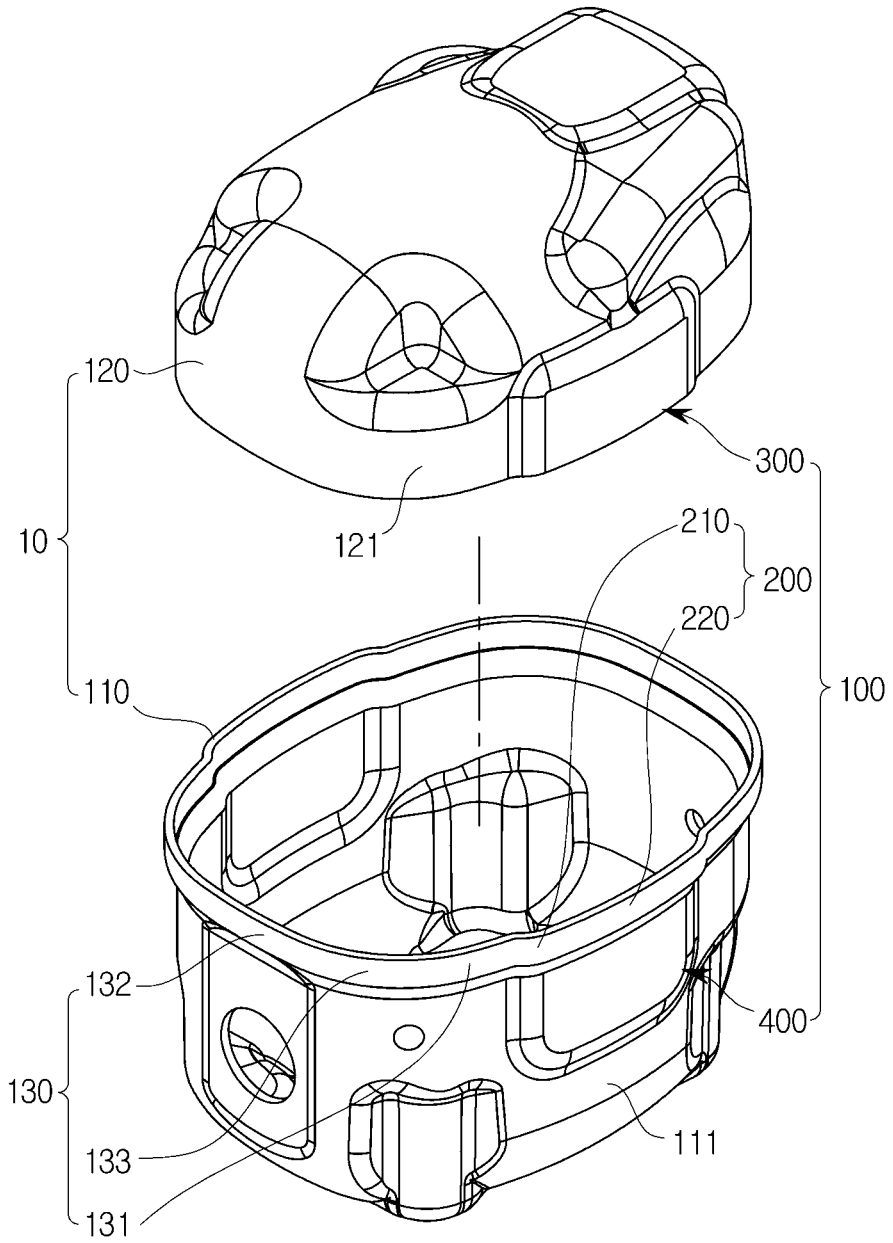
FIG. 3 illustrates an exploded-perspective view of the compressor in accordance with an embodiment of the present disclosure.

FIG. 3 illustrates an exploded-perspective view of the compressor in accordance with an embodiment of the present disclosure. According to an embodiment, the compressor 1 may include the housing 10 formed by a lower shell 110, an upper shell 120 coupled to the lower shell 110.

Generally, the lower shell 110 may include a plurality of pipes such as a suction pipe (not shown), a discharge pipe (not shown), and a process pipe (not shown).

The suction pipe (not shown) may allow the refrigerant to be introduced into the inside of the housing 10, and be mounted to the lower shell 110 by penetrating the lower shell 110. The suction pipe (not shown) may be additionally mounted to the lower shell 110 or integrally formed with the lower shell 110.

The discharge pipe (not shown) may discharge the refrigerant compressed in the lower shell 110 and be mounted to the lower shell 110 by penetrating the lower shell 110. The discharge pipe (not shown) may be also additionally mounted to the lower shell 110 or integrally formed with the lower shell 110.

The process pipe (not shown) may be configured to charge the inside of the lower shell 110 with the refrigerant after closing the inside of the lower shell 110, and in the same as the suction pipe (not shown) and the discharge pipe (not shown), the process pipe (not shown) may be mounted to the lower shell 110 by penetrating the lower shell 110.

The compressor 1 may include a power supply (not shown) provided in the lower shell 110. The power supply (not shown) may be configured to supply power to a variety of components accommodated in the lower shell 110, and mounted to the lower shell 110 by penetrating the lower shell 110.

The housing 10 may include a coupling portion 130 formed in an end portion of the lower shell 110 to be integrally formed with the lower shell 110, and configured to protrude from the side surface of the lower shell 110 to the outside. The coupling portion 130 may protrude from the side surface of the lower shell 110 to the outside to accommodate a part of the upper shell 120, but is not limited thereto.

Alternatively, the coupling portion 130 may be formed in an end portion of the upper shell 120 to be integrally with the upper shell 120 and configured to protrude from the side surface of the upper shell 120 to the outside. The coupling portion 130 may protrude from the side surface of the upper shell 120 to the outside to accommodate a part of the lower shell 110, but is not limited thereto.

Since the upper shell 120 is coupled to the coupling portion 130, the housing 10 formed with the upper shell 120, the lower shell 110 and the coupling portion 130 may be closed. The lower shell 110 and the coupling portion 130 may be integrally manufactured with each other and in a state in which the upper shell 120 is coupled to the coupling portion 130, the upper shell 120 may close the inside of the housing 10 by wielding.

The coupling portion 130 may include a first coupling portion 131, a second coupling portion 132 having a length shorter than a length of the first coupling portion 131, and a third coupling portion 133 having a curvature and connecting the first coupling portion 131 to the second coupling portion 132, but is not limited thereto.

Alternatively, a length of the first coupling portion 131 may be the same as or less than a length of the second coupling portion 132.

The main portion may include a lower main portion 111 forming an appearance of the lower shell 110, and an upper main portion 121 forming an appearance of the upper shell 120.

The upper shell 120 may include an upper protrusion 300 protruding from the upper main portion 121 to the outside. The lower shell 110 may include a lower protrusion 400 protruding from the lower main portion 111 to the outside.

The upper protrusion 300 and the lower protrusion 400 may be coupled to each other by the coupling portion 130. The coupling portion 130 may include the coupling protrusion 200 in which the upper protrusion 300 and the lower protrusion 400 are coupled to each other. The coupling protrusion 200 may be provided in the first coupling portion 131.

Generally, when the power is applied to the compressor 1, the suction, the compression, and the discharge of the refrigerant gas may be sequentially performed in the housing 10.

The coupling portion 130 configured to allow the upper shell 120 to be coupled to the lower shell 110 may be vulnerable to a micro-vibration, and thus a noise may be generated by the vibration during the compressor 1 is driven.

Therefore, by forming the coupling protrusion 200 in the coupling portion 130, it may be possible to move the natural frequency of the coupling portion 130 to the high frequency.

Since the coupling protrusion 200 is provided in the coupling portion 130, the rigidity of the coupling portion 130 may be increased to reduce the vibration of the upper shell 120 and the lower shell 110, and thus it may be possible to reduce the noise radiated via the housing 10

According to an embodiment, during the compressor 1 is driven, the compressor 1 may be more resistant to the vibration generated in the coupling portion 130 and thus the noise generated in the coupling portion 130 may be reduced while a quality of the noise generated in the coupling portion 130 is relatively improved.

The upper shell 120 may include an upper protrusion 300 extended from the coupling protrusion 200 to the upper shell 120. The lower shell 110 may include a lower protrusion 400 extended from the coupling protrusion 200 to the lower shell 110.

An outer surface of the upper protrusion 300 may be in contact with an inner surface of the coupling protrusion 200, but is not limited thereto. Alternatively, when the coupling portion 130 is provided in an end portion of the upper shell 120, the outer surface of the lower protrusion 400 may be in contact with the inner surface of the coupling protrusion 200.

A height in which the upper protrusion 300 protrudes from the side surface of the upper main portion 121 to the outside, may be the same as a height in which the lower protrusion 400 protrudes from the side surface of the lower main portion 111 to the outside, but is not limited thereto.

Alternatively, the height in which the upper protrusion 300 protrudes from the side surface of the upper main portion 121 to the outside, and the height in which the lower protrusion 400 protrudes from the side surface of the lower main portion 111 to the outside may vary as long as capable of increasing the rigidity of the upper shell 120 and the lower shell 110.

In order to form a bead to increase the rigidity, the coupling protrusion 200 may be integrally coupled with the upper protrusion 300 and the lower protrusion 400 to form the protrusion 100.

The coupling protrusion 200 may protrude by a height corresponding to from ⅙ (one sixth) to third times of the thickness of the protrusion 100, but is not limited thereto. Alternatively, the height in which the coupling protrusion 200 protrudes, may vary as long as capable of reducing the noise by reducing the vibration, which is transmitted, by improving the rigidity of the coupling protrusion 200.

The coupling protrusion 200 may be formed to be stepped. The upper protrusion 300 may be extended from the coupling protrusion 200 to the upper shell 120 with a stepped portion. The lower protrusion 400 may be extended from the coupling protrusion 200 to the lower shell 110 with the stepped portion.

The lower protrusion 400 may be in parallel with the upper protrusion 300.

Figure 4:
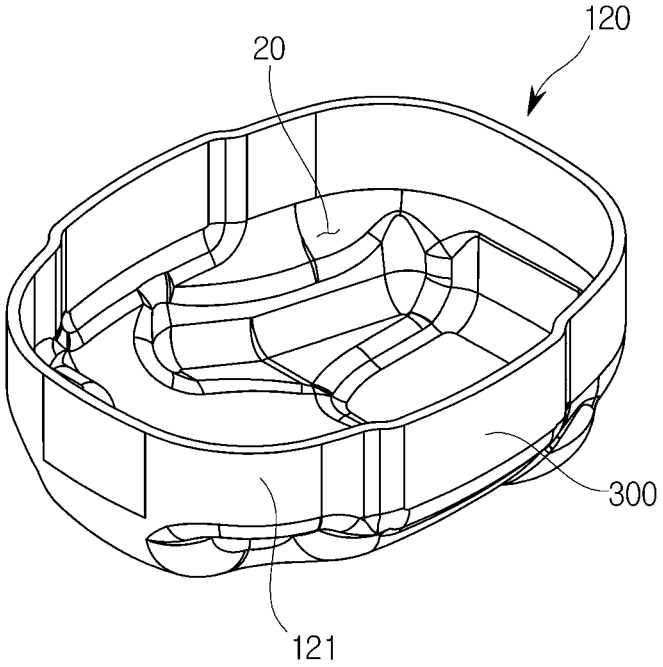
FIG. 4 illustrates a perspective view of an inner surface of the upper shell in the compressor in accordance with an embodiment of the present disclosure.
Figure 5:
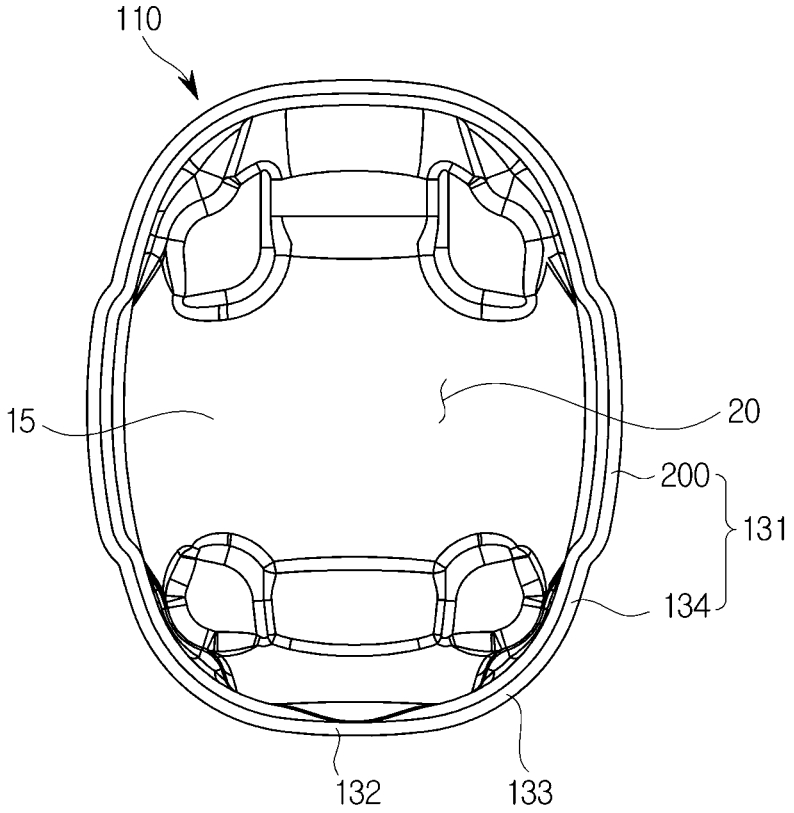
FIG. 5 illustrates a view of an inner surface of the lower shell in the compressor in accordance with an embodiment of the present disclosure.

FIG. 4 illustrates a perspective view of an inner surface of the upper shell in the compressor in accordance with an embodiment of the present disclosure. FIG. 5 illustrates a view of an inner surface of the lower shell in the compressor in accordance with an embodiment of the present disclosure.

The upper shell 120 may include a part of the accommodating portion 20 in which the compression device 30 and the drive device 40 are accommodated.

The upper shell 120 may include the upper protrusion 300 protruding outward from the upper main portion 121. As the upper protrusion 300 protrudes to the outside, the space of the accommodating portion 20 may be slightly increased.

The lower shell 110 may include a part of the accommodating portion 20 in which the compression device 30 and the drive device 40 are accommodated.

The upper shell 120 may include the lower protrusion 400 protruding outward from the lower main portion 111. As the lower protrusion 400 protrudes to the outside, the space of the accommodating portion 20 may be slightly increased.

The first coupling portion 131 may include a flange portion 134 connected to the third coupling portion 133 and at least one the coupling protrusion 200 extended from the side surface of the flange portion 134 to the outside.

The flange portion 134 may accommodate a part of the upper shell 120 or the lower shell 110 and the coupling protrusion 200 may increase the rigidity of the coupling portion 130.

The coupling portion 130 may include a plurality of the coupling portions 130 disposed to face to each other. The coupling protrusion 200 may be provided in plural to correspond to each of the plurality of the coupling portions 130.

The coupling protrusion 200 may include a first coupling protrusion 210 extended and bent from the flange portion 134 and a second coupling protrusion 220 extended and bent from the first coupling protrusion 210.

The coupling protrusion 200 may be provided in the first coupling portion 131 and extended from the side surface of the flange portion 134 to the outside with a stepped portion.

The lower shell 110 may include the bottom portion 15 forming the bottom surface of the housing 10.

Figure 6:
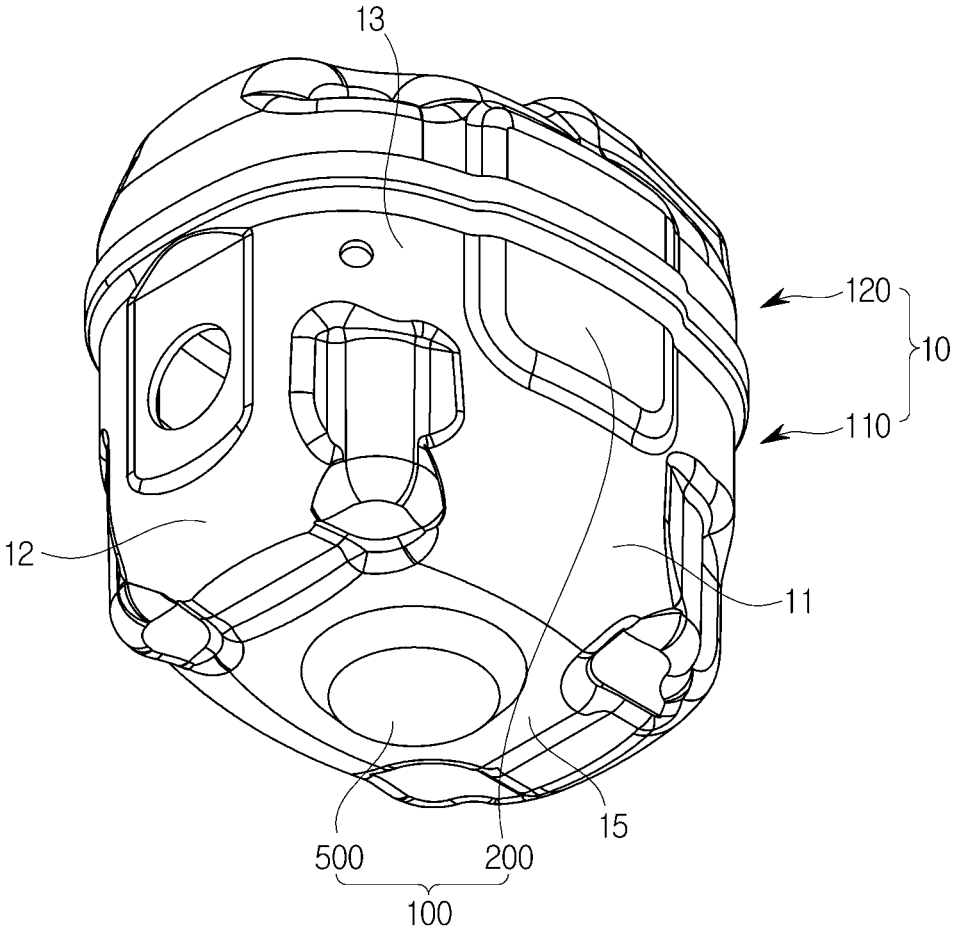
FIG. 6 illustrates a view of a bottom protrusion in a compressor in accordance with another embodiment of the present disclosure.

FIG. 6 illustrates a view of a bottom protrusion in a compressor in accordance with another embodiment of the present disclosure. As illustrated in FIG. 6, a bottom portion 15 may be connected to a first side portion 11, a second side portion 12 and a third side portion 13.

The bottom portion 15 may include a bottom protrusion 500 protruding from the lower main portion 111 to the outside to increase the rigidity of a lower shell 110. The bottom protrusion 500 may protrude by a height corresponding to from one tenth (1/10) to five times of the thickness of the lower shell 110, but is not limited thereto.

Alternatively, the height in which the bottom protrusion 500 protrudes, may vary as long as capable of reducing the noise by reducing the vibration, which is transmitted, by improving the rigidity of the bottom protrusion 500.

A protrusion 100 may include the bottom protrusion 500, and a coupling protrusion 200 provided between the upper shell 120 and the lower shell 110 forming the housing 10.

Figure 7:
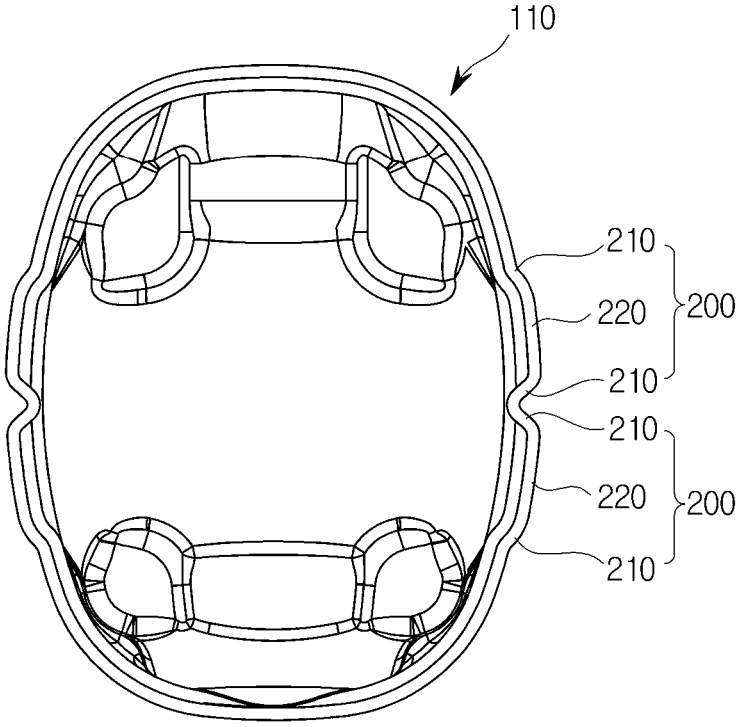
FIG. 7 illustrates a view of an inner surface of a lower shell in the compressor in accordance with another embodiment of the present disclosure.

FIG. 7 illustrates a view of an inner surface of a lower shell in the compressor in accordance with another embodiment of the present disclosure. As illustrated in FIG. 7, a plurality of coupling protrusions 200 integrally formed with a lower shell 110 may be provided in at least one of a plurality of coupling portions 130.

Two coupling protrusions 200 may be provided in a single one first coupling protrusion 131, but is not limited thereto. Alternatively, a varying number of the first coupling portion 131 may be formed as long as capable of increasing the rigidity of the coupling portion 130.

The coupling protrusion 200 may include two first coupling protrusions 210 and a second coupling protrusion 220 connecting the two first coupling protrusions 210 to each other.

According to an embodiment, the coupling protrusion 200 may be formed to be inclined. The second coupling protrusion 220 connecting the two first coupling protrusions 210 may be formed to be inclined. The plurality of the first coupling portions 210 may have a different curvature.

In comparison with a case in which the coupling protrusion 200 is formed in a horizontal manner, when the coupling protrusion 200 is formed at a certain angle, the coupling protrusion 200 may prevent the vibration even when the vibration is generated in any direction.

Figure 8:
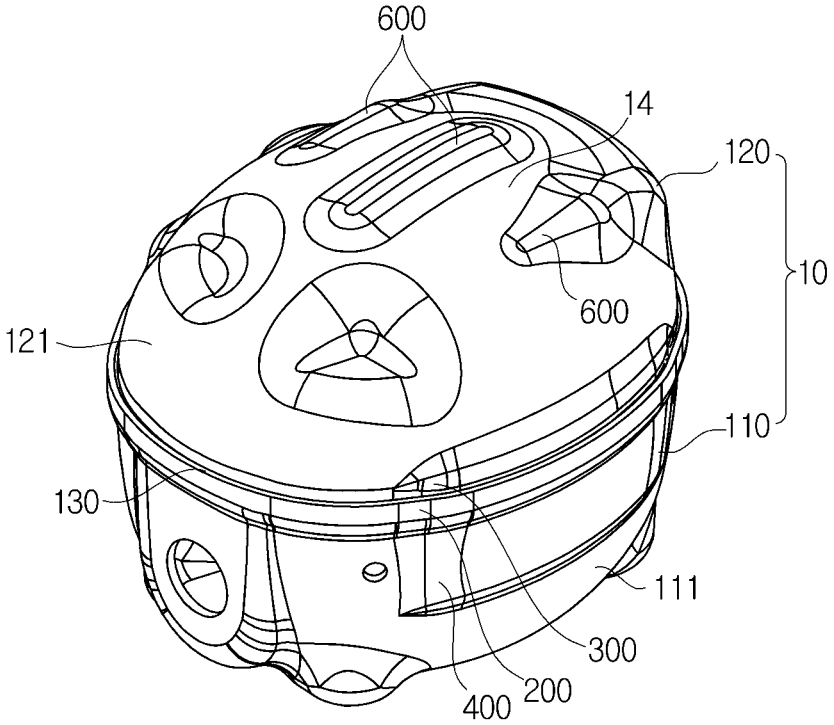
FIG. 8 illustrates a view of a coupling protrusion and a ceiling protrusion of an upper shell in a compressor in accordance with another embodiment of the present disclosure.
Figure 9:
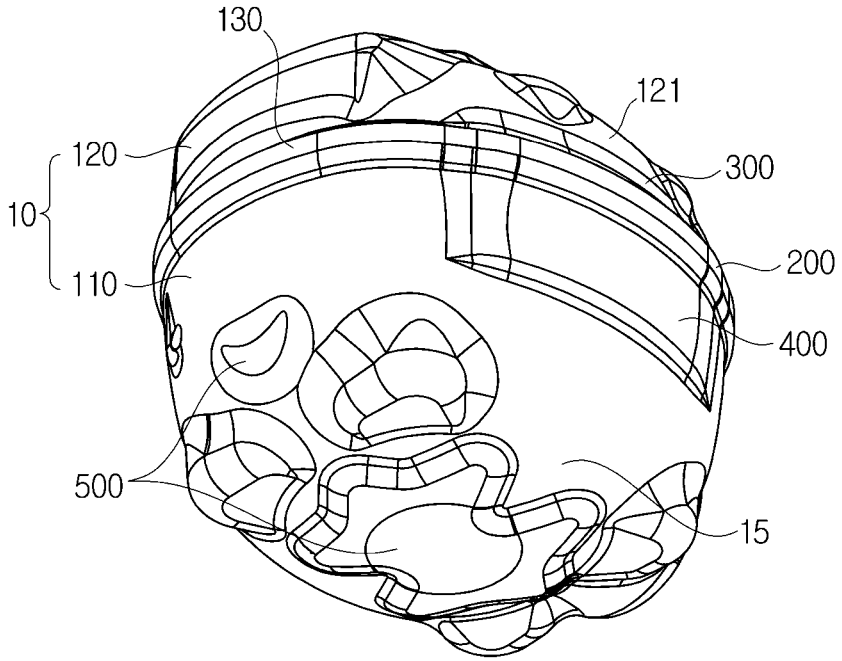
FIG. 9 illustrates a view of the coupling protrusion and a bottom protrusion of a lower shell in the compressor of FIG. 8 in accordance with another embodiment of the present disclosure.

FIG. 8 illustrates a view of a coupling protrusion and a ceiling protrusion of an upper shell in a compressor in accordance with another embodiment of the present disclosure. FIG. 9 illustrates a view of the coupling protrusion and a bottom protrusion of a lower shell in the compressor of FIG. 8 in accordance with another embodiment of the present disclosure.

A compressor 1 according to another embodiment, as illustrated in FIGS. 8 and 9, may be mainly used in a refrigerator, but is not limited thereto.

As illustrated in FIGS. 8 and 9, the compressor 1 according to another embodiment may include a coupling protrusion 200 provided in a coupling portion 130 in the same as the compressor 1 used in the air purifier.

An upper shell 120 may include an upper protrusion 300 extended from the coupling protrusion 200 to the upper shell 120. A lower shell 110 may include a lower protrusion 400 extended from the coupling protrusion 200 to the lower shell 110.

The coupling protrusion 200, the upper protrusion 300 and the lower protrusion 400 of the compressor 1 according to another embodiment may include all features of the coupling protrusion 200, the upper protrusion 300 and the lower protrusion 400 of the compressor 1 according to an embodiment.

According to another embodiment, the upper shell 120 may include a ceiling protrusion 600 protruding to the upper side from an upper main portion 121 to increase the rigidity of the upper shell 120.

The ceiling protrusion 600 may protrude by a height corresponding to corresponding to from one tenth (1/10) to five times of the thickness of the upper shell 120, but is not limited thereto.

Alternatively, the height in which the ceiling protrusion 600 protrudes, may vary as long as capable of reducing the noise by reducing the vibration, which is transmitted to the upper shell 120, by improving the rigidity of the upper shell 120.

A shape of the ceiling protrusion 600 may vary as long as capable of protruding from the upper main portion 121.

The protrusion 100 may be provided in the upper portion 14 of the housing 10. The ceiling protrusion 600 may be provided in the upper portion 14 of the housing 10.

A shape of the bottom protrusion 500 protruding from the lower main portion 111 to the lower side may vary. Alternatively, the bottom protrusion 500 may be provided not in the bottom portion 15, but in the lower side of the second side portion 12 connected to the bottom portion 15.

The protrusion 100 may include the upper protrusion 300, the lower protrusion 400, the coupling protrusion 200, the bottom protrusion 500 and the ceiling protrusion 600.

As is apparent from the above description, it may be possible to increase the rigidity of a housing of a compressor without changing a thickness of a steel plate forming the housing, by changing a shape of the housing of the compressor.

In addition, it may be possible to reduce a vibration, which is transmitted to a housing, particularly, a noise in the high-frequency, which is radiated to the outside from the housing, by increasing a rigidity of the housing by forming a protrusion having a certain curvature, in a side portion and a bottom portion, which are relatively vulnerable to the vibration of the housing.

Although a few embodiments of the present disclosure have been shown and described, it would be appreciated by those skilled in the art that changes may be made in these embodiments without departing from the principles and spirit of the disclosure, the scope of which is defined in the claims and their equivalents.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A compressor comprising:

an upper shell and a lower shell forming an exterior of the compressor; and a coupling portion provided between the upper shell and the lower shell and configured to:

protrude from a side surface of the upper shell to an outside of the lower shell, or a side surface of the lower shell to an outside the upper shell, wherein the coupling portion comprises:

a flange portion protruding on the outside of the lower shell or the outside of the upper shell, and at least one coupling protrusion configured to protrude further outside from the side surface of the upper shell or the lower shell than the flange portion, to increase a rigidity of the flange portion and the coupling portion, and wherein the upper shell comprises an upper protrusion extended from the at least one coupling protrusion to the upper shell, the upper protrusion forming a portion of the exterior of the compressor, and the upper protrusion comprises a first protrusion and a second protrusion comprising a transition and an approximately flat shape, and the first protrusion has a radius greater than a radius of the transition in the second protrusion.

2. The compressor of claim 1, wherein the at least one coupling protrusion comprises a first coupling protrusion bent and extended from the flange portion, and a second coupling protrusion bent and extended from the first coupling protrusion.

3. The compressor of claim 1, wherein the lower shell comprises a lower protrusion extended from the at least one coupling protrusion to the lower shell.

4. The compressor of claim 1, wherein the upper shell comprises a ceiling protrusion configured to protrude from an upper main portion forming an exterior of the upper shell, to an upper side, to increase a rigidity of the upper shell.

5. The compressor of claim 1, wherein the at least one coupling protrusion protrudes by a height ranging from one tenth (1/10) to five times of a thickness of the lower shell.

6. The compressor of claim 1, wherein the lower shell comprises a bottom protrusion configured to protrude from a lower main portion forming an exterior of the lower shell, to the outside, to increase a rigidity of the lower shell.

7. The compressor of claim 6, wherein the bottom protrusion protrudes by a height ranging from one tenth (1/10) to five times of a thickness of the lower shell.

8. The compressor of claim 1, wherein the coupling portion comprises a plurality of first coupling portions disposed to face to each other, wherein the at least one coupling protrusion is provided in plural to correspond to the plurality of first coupling portions.

9. The compressor of claim 8, wherein the at least one coupling protrusion is provided in plural in at least one first coupling portion among the plurality of first coupling portions.

10. The compressor of claim 1, wherein the at least one coupling protrusion is integrally coupled to the upper protrusion to form a bead protrusion configured to increase a rigidity of the upper shell.

11. The compressor of claim 1, wherein the at least one coupling protrusion is inclined.

12. The compressor of claim 1, wherein the at least one coupling protrusion is stepped.

13. The compressor of claim 1, wherein:

the coupling portion comprises:

a first coupling portion, a second coupling portion that includes a length less than a length of the first coupling portion, and a third coupling portion that includes a curvature and connecting the first coupling portion to the second coupling portion, and the at least one coupling protrusion is provided in the first coupling portion.

14. The compressor of claim 1, wherein an outer surface of the upper protrusion is in contact with an inner surface of the at least one coupling protrusion.

15. A compressor comprising:

a housing provided with an accommodating portion configured to accommodate a drive device and a compression device, wherein the housing comprises a main portion configured to form an exterior of the housing, and a protrusion configured to protrude from the main portion to outside the housing, and wherein the protrusion comprises:

a first protrusion provided on an edge portion of the protrusion and configured to be bent and extend from an outer surface of the main portion, and a second protrusion configured to be bent in a same direction as the first protrusion and extend further outside from the outer surface than the first protrusion and comprising a transition and an approximately flat shape, and wherein the first protrusion has a radius greater than a radius of the transition in the second protrusion.

16. The compressor of claim 15, wherein:

the housing comprises an upper shell and a lower shell configured to form the accommodating portion, a coupling portion provided between the upper shell and the lower shell to allow the upper shell to be coupled to the lower shell, and a part of the protrusion is provided in the coupling portion.

17. The compressor of claim 15, wherein the protrusion is provided in an upper portion of the housing.

18. The compressor of claim 15, wherein the protrusion is provided in a bottom portion of the housing.

* * * * *